US010035182B2

(12) United States Patent
Bochiechio et al.

(10) Patent No.: US 10,035,182 B2
(45) Date of Patent: Jul. 31, 2018

(54) METHOD OF FABRICATING AN INVESTMENT CASTING MOLD AND SLURRY THEREFOR

(71) Applicant: United Technologies Corporation, Farmington, CT (US)

(72) Inventors: Mario P. Bochiechio, Vernon, CT (US); John Joseph Marcin, Marlborough, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 15/804,296

(22) Filed: Nov. 6, 2017

(65) Prior Publication Data

US 2018/0056376 A1 Mar. 1, 2018

Related U.S. Application Data

(63) Continuation-in-part of application No. 14/534,616, filed on Nov. 6, 2014, now Pat. No. 9,827,608.

(60) Provisional application No. 61/913,487, filed on Dec. 9, 2013.

(51) Int. Cl.

| | |
|---|---|
| ***B22C 3/00*** | (2006.01) |
| ***B22D 21/02*** | (2006.01) |
| ***B22C 9/04*** | (2006.01) |
| *B22F 3/24* | (2006.01) |

(52) U.S. Cl.

CPC ..... *B22C 9/043* (2013.01); *B22C 3/00* (2013.01); *B22D 21/027* (2013.01); *B22F 2003/248* (2013.01)

(58) Field of Classification Search

CPC ..... B22D 21/02; B22D 21/025; B22C 3/00
USPC ..... 164/516–529; 106/38.2, 38.22, 38.27
See application file for complete search history.

(56) References Cited

U.S. PATENT DOCUMENTS

| | | | |
|---|---|---|---|
| 3,892,579 | A | 7/1975 | Mabie, Jr. |
| 4,304,605 | A | 12/1981 | Keibler |
| 4,703,806 | A | 11/1987 | Lassow et al. |
| 4,767,479 | A | 8/1988 | Ferguson et al. |
| 4,804,562 | A | 2/1989 | Ferguson et al. |
| 4,815,516 | A | 3/1989 | Sturgis et al. |
| 4,947,927 | A | 8/1990 | Horton |

(Continued)

OTHER PUBLICATIONS

Harris et al., Improved single crystal superalloys, CMSX-4(SLS)[La+Y] and CMSX-486, Superalloys 2004, Tms, pp. 45-52 (Year: 2004).*

(Continued)

*Primary Examiner* — Kevin E Yoon
(74) *Attorney, Agent, or Firm* — Carlson, Gaskey & Olds, P.C.

(57) ABSTRACT

A method of investment casting includes casting a liquid nickel- or cobalt-based superalloy in an investment casting mold. The superalloy includes an yttrium alloying element that is subject to reactive loss during the casting. Loss of the yttrium is limited by using a zircon-containing facecoat on a refractory investment wall in the investment casting mold. The facecoat contacts the liquid nickel- or cobalt-based superalloy during the casting. Prior to the casting, a zircon-containing slurry is used to form the facecoat. After solidification of the nickel- or cobalt-based superalloy, the refractory investment wall is removed from the solidified superalloy.

12 Claims, 1 Drawing Sheet

(56) References Cited

U.S. PATENT DOCUMENTS

| | | | |
|---|---|---|---|
| 5,335,717 | A | 8/1994 | Chin |
| 6,676,381 | B2 | 1/2004 | Subramanian |
| 6,966,354 | B2 | 6/2005 | Marcin, Jr. |
| 7,575,042 | B2 | 7/2009 | Bewlay |
| 7,588,633 | B2 | 9/2009 | Doles |
| 8,088,208 | B2 | 1/2012 | Stotzel |
| 2006/0144556 | A1 | 7/2006 | Wang |
| 2007/0144401 | A1 | 6/2007 | Harris |

OTHER PUBLICATIONS

Shi et al., Influence of yttrium addition on high temperature oxidation resistance of single crystal superalloy, Journal of Rare Earths, vol. 31, No. 8, pp. 795-799 (Year: 2013).*
U.S. Appl. No. 13/440,429, filed Apr. 5, 2012.

* cited by examiner

METHOD OF FABRICATING AN INVESTMENT CASTING MOLD AND SLURRY THEREFOR

CROSS-REFERENCE TO RELATED APPLICATION

This application is a Continuation of U.S. patent application Ser. No. 14/534,616, filed Nov. 6, 2014, which claims priority to U.S. Provisional Application No. 61/913,487, filed Dec. 9, 2013.

BACKGROUND

This disclosure relates to investment casting. Investment casting is known and used to cast metallic components with relatively complex geometries. For example, gas turbine engine components, such as airfoils, are fabricated by investment casting. For cast components that have internal passages, the internal passages can be formed using a core that represents a positive projection of negative features that are to be formed in the casting process. A wax pattern is provided around the core in the geometry of the component to be cast. A refractory shell is formed around the wax pattern and the wax is then removed to form a mold cavity between the core and the shell. Molten metal is poured into the cavity. After solidification of the metal, the shell and core are removed using known techniques, to release the cast component.

SUMMARY

A method of fabricating an investment casting mold according to an example of the present disclosure includes using a zircon-containing slurry to form a facecoat of a refractory investment wall of a mold cavity in an investment casting mold. The zircon-containing slurry includes, by weight, at least 70% of zircon powder.

In a further embodiment of any of the foregoing embodiments, the zircon-containing slurry includes, by weight, 10%-30% colloidal silica.

In a further embodiment of any of the foregoing embodiments, the colloidal silica includes, by weight, about 1-15% of a polymer.

In a further embodiment of any of the foregoing embodiments, the zircon-containing slurry includes, by weight, 0.001-0.020% of an anti-foaming agent.

In a further embodiment of any of the foregoing embodiments, the zircon-containing slurry includes, by weight, 0.001-0.5% of a surfactant.

In a further embodiment of any of the foregoing embodiments, the zircon powder has a size of −325 mesh.

In a further embodiment of any of the foregoing embodiments, the zircon-containing slurry includes, by weight, no greater than 90% of the zircon powder.

In a further embodiment of any of the foregoing embodiments, the zircon-containing slurry includes, by weight, 1%-10% of a carrier solvent.

In a further embodiment of any of the foregoing embodiments, further comprising casting a liquid metallic material in the mold cavity, the facecoat limiting loss of a reactive metal element from the liquid metallic material into the refractory investment wall.

In a further embodiment of any of the foregoing embodiments, the reactive metal element is yttrium.

A further embodiment of any of the foregoing embodiments includes selecting a yttrium-containing metal alloy to mold in the investment casting mold, and then selecting the zircon-containing slurry with respect to the yttrium in the yttrium-containing metal, to block yttrium loss into the refractory investment wall.

In a further embodiment of any of the foregoing embodiments, the zircon-containing slurry consists of the zircon powder, 10%-30% by weight of a colloidal silica material, and 1%-10% by weight of a carrier solvent.

A slurry for use in fabricating an investment casting mold according to an example of the present disclosure includes at least 70% of zircon powder, 10%-30% of colloidal silica material, and 1%-10% of a carrier solvent.

In a further embodiment of any of the foregoing embodiments, the colloidal silica material includes, by weight, 0.001%-0.020% of an anti-foaming agent.

In a further embodiment of any of the foregoing embodiments, the colloidal silica material includes, by weight, 0.001%-0.5% of a surfactant.

In a further embodiment of any of the foregoing embodiments, the zircon-containing slurry includes, by weight, no greater than 90% of the zircon powder.

In a further embodiment of any of the foregoing embodiments, the zircon-containing slurry consists of the zircon powder, the colloidal silica material, and the carrier solvent.

An investment casting mold according to an example of the present disclosure includes a refractory investment wall at least partially defining a mold cavity. The refractory investment wall includes a facecoat having, by weight, at least 70% zircon.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Articles can be cast in investment molds from a molten metallic alloy. One example class of alloys useful for gas turbine engine articles are superalloys. Superalloys are nickel- or cobalt-based alloys. When the alloy is in a molten state, alloy elements can react with the materials of the walls of a pourcup (used to pour the molten alloy into an investment mold), the walls of the investment mold, or both. The reaction results in the loss of the element or elements from the composition of the alloy. Element loss can reduce the alloy composition below required levels. Alternatively, a casting operator can add an additional amount of the element into the molten alloy to mitigate the loss, which can increase the complexity of the process and add cost. As will be described, the examples herein provide a slurry for fabricating an investment mold with a facecoat to reduce reactivity of elements in a molten alloy and limit element loss, which can reduce process complexity and reduce costs.

Figure 1:
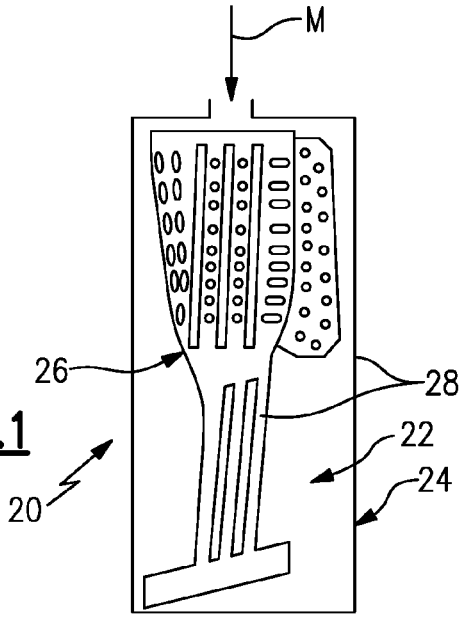
FIG. 1 illustrates an example investment mold.

FIG. 1 schematically illustrates selected portions of an example investment mold 20. In this example, the investment mold 20 is configured for casting a gas turbine engine article, such as an airfoil. It is to be understood, however, that the investment mold 20 is not limited to airfoils or gas turbine engine articles, and the examples herein will also benefit other kinds of investment cast articles.

In the illustrated example, the investment mold 20 includes a mold cavity 22 that is generally surrounded by a refractory shell 24 (hereafter "shell 24"). A refractory core 26 (hereafter "core 26") is situated within the mold cavity 22 and serves to form internal passages in the cast component. The shell 24 and the core 26 include refractory investment walls 28 that bound and define the mold cavity 22. As can be appreciated, some components may not have internal passages and may therefore not utilize the core 26. For example, the term "refractory" refers to a material that retains good strength at high temperatures (see also ASTM Volume 15.01 Refractories; Activated Carbon, Advanced Ceramics), such as above a temperature of 1,000° F. (811 K; 538° C.). In a further example, the refractory investment walls 28 are walls that, in the cast-ready state include, by weight, a total composition having a predominant amount of refractory material or materials, and in some examples 75% or greater, or 90% or greater, by weight of refractory material or materials. As can be further appreciated, the refractory investment walls 28 can be uni- or multi-layered.

Figure 2:
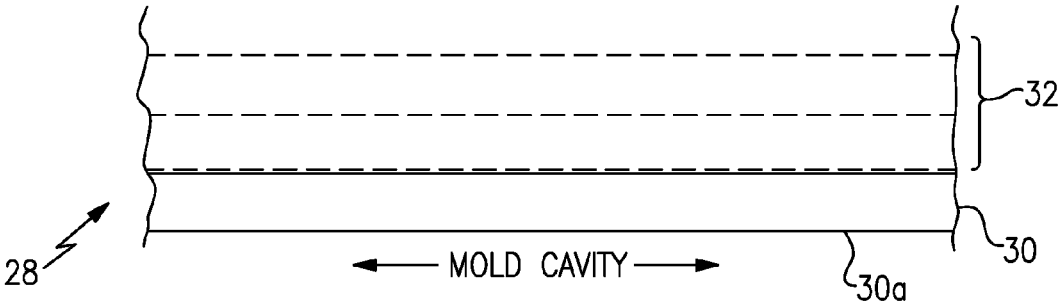
FIG. 2 illustrates a portion of a refractory investment wall of the investment mold of FIG. 1.

FIG. 2 illustrates a portion of one of the refractory investment walls 28, which can be in the refractory shell 24, in the refractory core 26 or both. The refractory investment wall 28 includes a facecoat 30 that at least partially bounds the mold cavity 22. In this regard, the facecoat 30 has at least one free surface 30*a* that is exposed to the mold cavity 22 and thus comes into direct contact with a molten metallic material during the investment casting process.

The refractory investment wall 28 can also have one or more additional refractory layers, generally represented at 32, that back the facecoat 30 relative to the mold cavity 22. For example, the refractory layers 32 can include ceramic materials that are known for use in investment molds.

The facecoat 30 includes, by weight, at least 70% zircon. Zircon has a chemical name of zirconium silicate or zirconium orthosilicate, and a chemical formula of $ZrSiO_4$. The zircon of the facecoat 30 functions as a barrier to block loss of reactive elements from the molten metallic material during the investment casting process. For example, yttrium is one reactive element that is used in superalloy materials. Alloys that contain yttrium are challenging to investment cast because of the reactivity of yttrium with ceramic or oxide materials that are used in investment casting molds and pourcups. The zircon of the facecoat 30 is relatively unreactive with respect to the yttrium and thus reduces reactivity and loss of yttrium from the molten metallic material. The retained yttrium in the cast article subsequently can enhance oxidation resistance.

Figure 3:
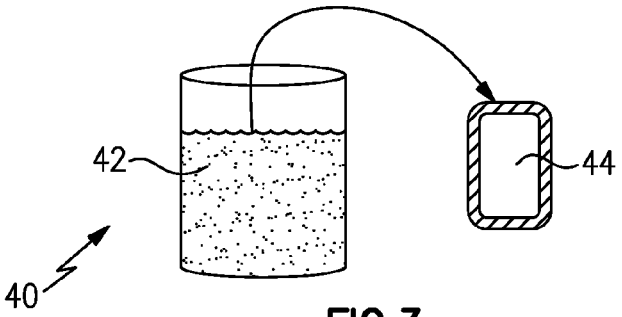
FIG. 3 pictorially illustrates a method of fabricating an investment casting mold.

FIG. 3 pictorially illustrates a non-limiting example of fabricating an investment casting mold that includes the zircon-containing facecoat 30. The method 40 includes using a zircon-containing slurry 42 to form the facecoat 30. The zircon-containing slurry 42 includes, by weight, at least 70%, and no more than 90%, of zircon powder. In one example, the zircon powder has a size of −325 mesh. The example size facilitates suspending the zircon particles in the slurry 42.

In further examples, the zircon-containing slurry 42 includes, in addition to the zircon powder, 10%-30% by weight of a colloidal silica material and 1%-10% by weight of a carrier solvent. One example carrier solvent is deionized water. The colloidal silica material can include a polymer binder, an anti-foaming agent, and a surfactant. In one example, the colloidal silica includes 1-15 wt % of the polymer, and in a further example can include 3-6 wt %. Non-limiting examples of the polymer include HP Laytex or Polyvinyl Alcohol (PVA). The colloidal silica material can also include 0.001%-0.020% of the anti-foaming agent. Non-limiting examples of the anti-foaming agent include Antifoam 60 or Burst RSD 10. The colloidal silica material can also include 0.001%-0.500% of the surfactant. Non-limiting examples of the surfactant include Antarox BL240 or Nalco-8815. In one further example, the colloidal silica has an average silica nanoparticle size of 1-50 nanometers. In further examples, the average silica nanoparticle size is about 7 nanometers, about 12 nanometers, or about 22 nanometers. In a further example, the zircon-containing slurry 42 includes only the zircon, colloidal silica material and carrier solvent.

The zircon-containing slurry 42 can be applied to form at least a portion of the refractory investment wall 28. As an example, the facecoat 30 can be formed on the shell 24, the core 26, or both. For the shell 24, the zircon-containing slurry 42 can be applied to a wax or other fugitive pattern, represented at 44 in FIG. 3. Similarly, the zircon-containing slurry 42 could also be applied as a coating on the core 26. After application of the zircon-containing slurry 42, the slurry can be dried and fired to convert the slurry to the facecoat 30.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A method of investment casting, the method comprising:

casting a liquid nickel- or cobalt-based superalloy in an investment casting mold, the liquid nickel- or cobalt-based superalloy having a composition including at least one alloying element that is subject to reactive loss during the casting, the at least one alloying element including yttrium;

limiting the loss of the yttrium element from the composition by using a zircon-containing facecoat on a refractory investment wall in the investment casting mold, the facecoat contacting the liquid nickel- or cobalt-based superalloy during the casting, wherein the facecoat includes, by weight, at least 70% of zircon; and after solidification of the nickel- or cobalt-based superalloy, removing the refractory investment wall from the solidified superalloy.

2. The method as recited in claim 1, wherein the refractory investment wall includes multiple refractory layers that back the facecoat.

3. The method as recited in claim 1, wherein the refractory investment wall includes a mold shell that surrounds a mold cavity, and the mold shell includes the facecoat.

4. The method as recited in claim 1, wherein the facecoat includes colloidal silica.

5. The method as recited in claim 1, wherein the facecoat includes, by weight, at least 10% colloidal silica.

6. A method of investment casting, the method comprising:

casting an airfoil in an investment casting mold from a liquid nickel- or cobalt-based superalloy, the liquid nickel- or cobalt-based superalloy having a composition including at least one alloying element that is subject to reactive loss during the casting, the at least one alloying element including yttrium;

limiting the loss of the yttrium element from the composition by using a zircon-containing facecoat on a refractory investment wall in the investment casting mold, the facecoat contacting the liquid nickel- or cobalt-based superalloy during the casting, wherein the facecoat includes, by weight, at least 70% of zircon; and after solidification of the nickel- or cobalt-based superalloy to form the airfoil, removing the refractory investment wall from the airfoil.

7. The method as recited in claim 6, wherein the facecoat includes, by weight, at least 10% colloidal silica.

8. The method as recited in claim 7, wherein the refractory investment wall includes multiple refractory layers that back the facecoat.

9. The method as recited in claim 8, wherein the refractory investment wall includes a mold shell that surrounds a mold cavity, and the mold shell includes the facecoat.

10. A method of investment casting, the method comprising:

casting an airfoil in an investment casting mold from a liquid nickel- or cobalt-based superalloy, the liquid nickel- or cobalt-based superalloy having a composition including at least one alloying element that is subject to reactive loss during the casting, the at least one alloying element including yttrium;

limiting the loss of the yttrium element from the composition by using a zircon-containing layer in a multi-layer refractory investment wall of the investment casting mold, wherein the layer includes, by weight, at least 70% of zircon; and after solidification of the nickel- or cobalt-based superalloy to form the airfoil, removing the multi-layer refractory investment wall from the airfoil.

11. The method as recited in claim 10, wherein the layer includes, by weight, at least 10% colloidal silica.

12. The method as recited in claim 11, wherein the refractory investment wall includes a mold shell that surrounds a mold cavity, and the mold shell includes the layer.

* * * * *